US012510096B2

(12) United States Patent
Furutani et al.

(10) Patent No.: US 12,510,096 B2
(45) Date of Patent: Dec. 30, 2025

(54) FAN

(71) Applicant: Carrier Japan Corporation, Tokyo (JP)

(72) Inventors: Yuki Furutani, Hiratsuka (JP); Yoshihiro Komiyama, Fuji (JP)

(73) Assignee: Carrier Japan Corporation, Tokyo (JP)

( * ) Notice: Subject to any disclaimer, the term of this patent is extended or adjusted under 35 U.S.C. 154(b) by 0 days.

(21) Appl. No.: 18/704,146

(22) PCT Filed: Oct. 26, 2022

(86) PCT No.: PCT/JP2022/039944

§ 371 (c)(1),
(2) Date: Apr. 24, 2024

(87) PCT Pub. No.: WO2023/074741

PCT Pub. Date: May 4, 2023

(65) Prior Publication Data

US 2025/0237230 A1 Jul. 24, 2025

(30) Foreign Application Priority Data

Oct. 29, 2021 (JP) ..... 2021-177274

(51) Int. Cl.
*F04D 29/52* (2006.01)
*F04D 19/00* (2006.01)

(52) U.S. Cl.
CPC ..... *F04D 29/522* (2013.01); *F04D 19/002* (2013.01)

(58) Field of Classification Search
CPC .... F04D 29/526; F04D 29/541; F04D 29/547; F04D 29/522; F04D 29/667; F04D 19/002
See application file for complete search history.

(56) References Cited

U.S. PATENT DOCUMENTS 4,548,548 A * 10/1985 Gray, III ..... F04D 29/544 416/189
5,489,186 A * 2/1996 Yapp ..... F01D 5/141 415/58.7

(Continued)

FOREIGN PATENT DOCUMENTS

CN 201891676 U 7/2011
CN 104481931 A 4/2015

(Continued)

OTHER PUBLICATIONS

International Search Report mailed on Dec. 6, 2022 in PCT/JP2022/039944 filed on Oct. 26, 2022, 11 pages (with English translation).

*Primary Examiner* — Nathaniel E Wiehe
*Assistant Examiner* — Maxime M Adjagbe
(74) *Attorney, Agent, or Firm* — Oblon, McClelland, Maier & Neustadt, L.L.P.

(57) ABSTRACT

A fan of which the blowing efficiency can be increased, the fan including a blade and a bell mouth. The blade rotates around a rotation axis that is along a first direction. The bell mouth includes a staircase structure positioned around the blade along a first plane perpendicular to the first direction. The staircase structure surrounds an opening that spreads toward a blowing direction of the blade.

9 Claims, 10 Drawing Sheets

(56) References Cited

U.S. PATENT DOCUMENTS

| | | | | |
|---|---|---|---|---|
| 5,803,709 | A * | 9/1998 | Matthews | F04D 19/002 415/222 |
| 10,844,868 | B2 * | 11/2020 | Van Houten | F04D 29/526 |
| 2008/0075585 | A1 * | 3/2008 | Acre | F04D 29/164 415/177 |
| 2009/0193831 | A1 * | 8/2009 | Kim | F24F 1/40 416/189 |
| 2018/0087440 | A1 | 3/2018 | Yamazaki et al. | |

FOREIGN PATENT DOCUMENTS

| | | | |
|---|---|---|---|
| JP | 2016-173210 | A | 9/2016 |
| JP | 2018-53823 | A | 4/2018 |

* cited by examiner

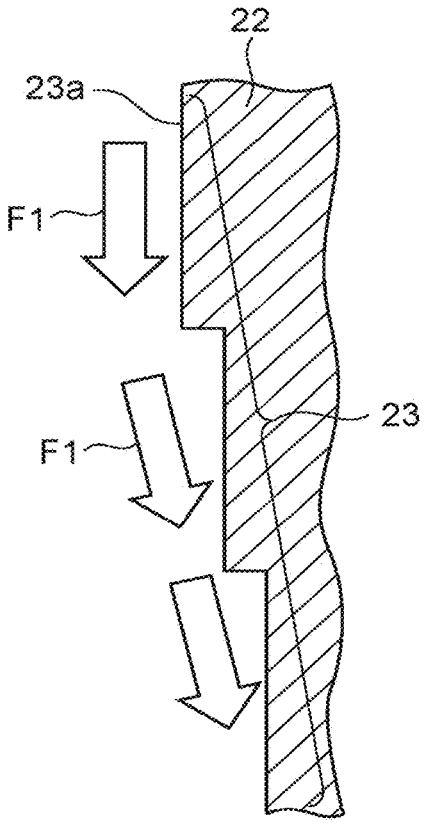
FIG. 5A
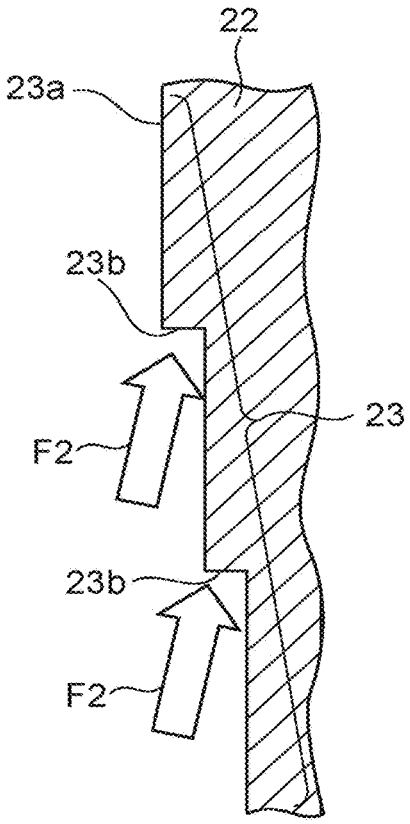
FIG. 5B
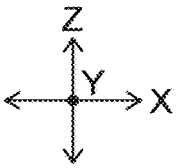

FAN

TECHNICAL FIELD

Embodiments of the invention relate to a fan.

BACKGROUND ART

There is a fan that blows air. Technology that can increase the blowing efficiency of the fan is desirable.

CITATION LIST

Patent Literature

[Patent Literature 1]
JP-A-2016-173210 (Kokai)

SUMMARY OF INVENTION

Problem to be Solved by Invention

The problem to be solved by the invention is to provide a fan of which the blowing efficiency can be increased.

Means for Solving Problem

A fan according to an embodiment includes a blade and a bell mouth. The blade rotates around a rotation axis that is along a first direction. The bell mouth includes a staircase structure positioned around the blade along a first plane perpendicular to the first direction. The staircase structure surrounds an opening that spreads toward a blowing direction of the blade.

BRIEF DESCRIPTION OF DRAWINGS

FIGS. 5A and 5B are schematic views showing a part of the fan according to the embodiment.

MODES FOR CARRYING OUT THE INVENTION

Figure 1:
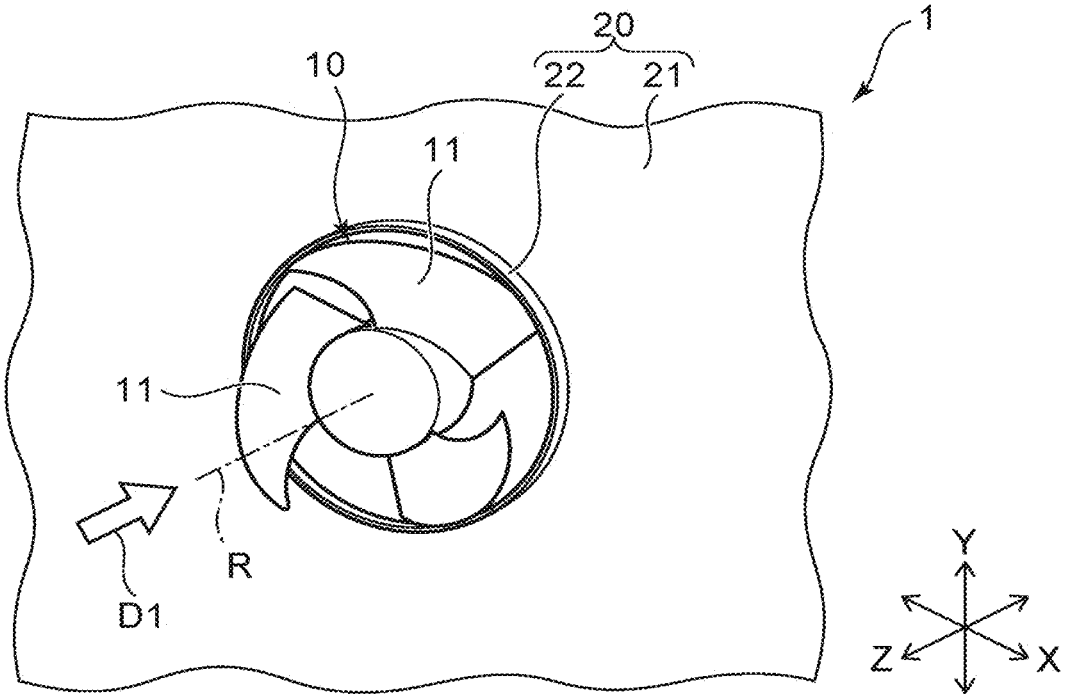
FIG. 1 is a perspective view showing a fan according to an embodiment.

Various embodiments of the invention will be described hereinafter with reference to the accompanying drawings.

The drawings are schematic and conceptual; and the relationships between the thickness and width of portions, the proportions of sizes among portions, etc., are not necessarily the same as the actual values. The dimensions and proportions may be illustrated differently among drawings, even for identical portions.

In the specification and drawings, components similar to those described previously or illustrated in an antecedent drawing are marked with like reference numerals, and a detailed description is omitted as appropriate.

FIG. 1 is a perspective view showing a fan according to an embodiment.

As shown in FIG. 1, the fan 1 according to the embodiment includes a blade 10 and a bell mouth 20. An X-direction, a Y-direction, and a Z-direction (a first direction) are used in the description herein. The X-direction, the Y-direction, and the Z-direction are mutually-orthogonal.

The blade 10 rotates around a rotation axis R, which is along the Z-direction. The blade 10 includes multiple vanes 11 tilted with respect to the X-Y plane (a first plane) perpendicular to the Z-direction. Three vanes 11 are included in the illustrated example. The number of the vanes 11 is modifiable as appropriate. Air is moved in a blowing direction D1 by the blade 10 rotating.

The bell mouth 20 includes a base part 21 and a ring part 22. The base part 21 has a plate shape spreading along the X-Y plane. The ring part 22 has a circular shape centered on the rotation axis R when viewed along the Z-direction. The blade 10 is located inside the ring part 22.

For example, the fan 1 according to the embodiment is used in an outdoor unit, a ventilation fan, etc.

Figure 2:
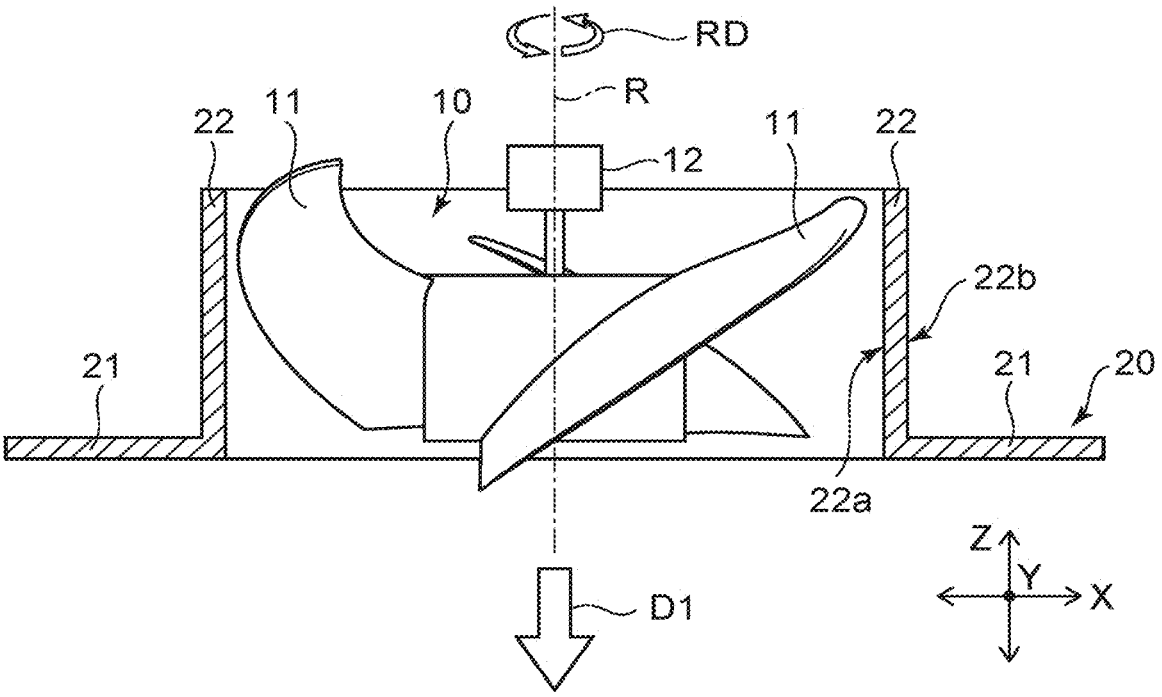
FIG. 2 is a side view showing the fan according to the embodiment.

FIG. 2 is a side view showing the fan according to the embodiment. FIG. 2 shows the cross-sectional structure of the bell mouth. A drive part 12 shown in FIG. 2 is not illustrated in FIG. 1.

As shown in FIG. 2, the drive part 12 is connected to the blade 10. The drive part 12 is, for example, a motor. The rotation axis R of the drive part 12 is connected to the center of the blade 10 in the X-Y plane. The drive part 12 rotates the blade 10 in a rotation direction RD.

In the example shown in FIG. 2, the drive part 12 is located at the opposite side of the blade 10 from the blowing direction D1 side. In other words, the drive part 12 is located at the upstream side of the blade 10. The drive part 12 is not limited to the example; the drive part 12 may be located at the blowing direction D1 side of the blade 10.

The ring part 22 is positioned around the blade 10 at the X-Y plane. The ring part 22 includes an inner circumferential surface 22*a* facing the blade 10, and an outer circumferential surface 22*b* at the side opposite to the inner circumferential surface 22*a*.

Figure 3:
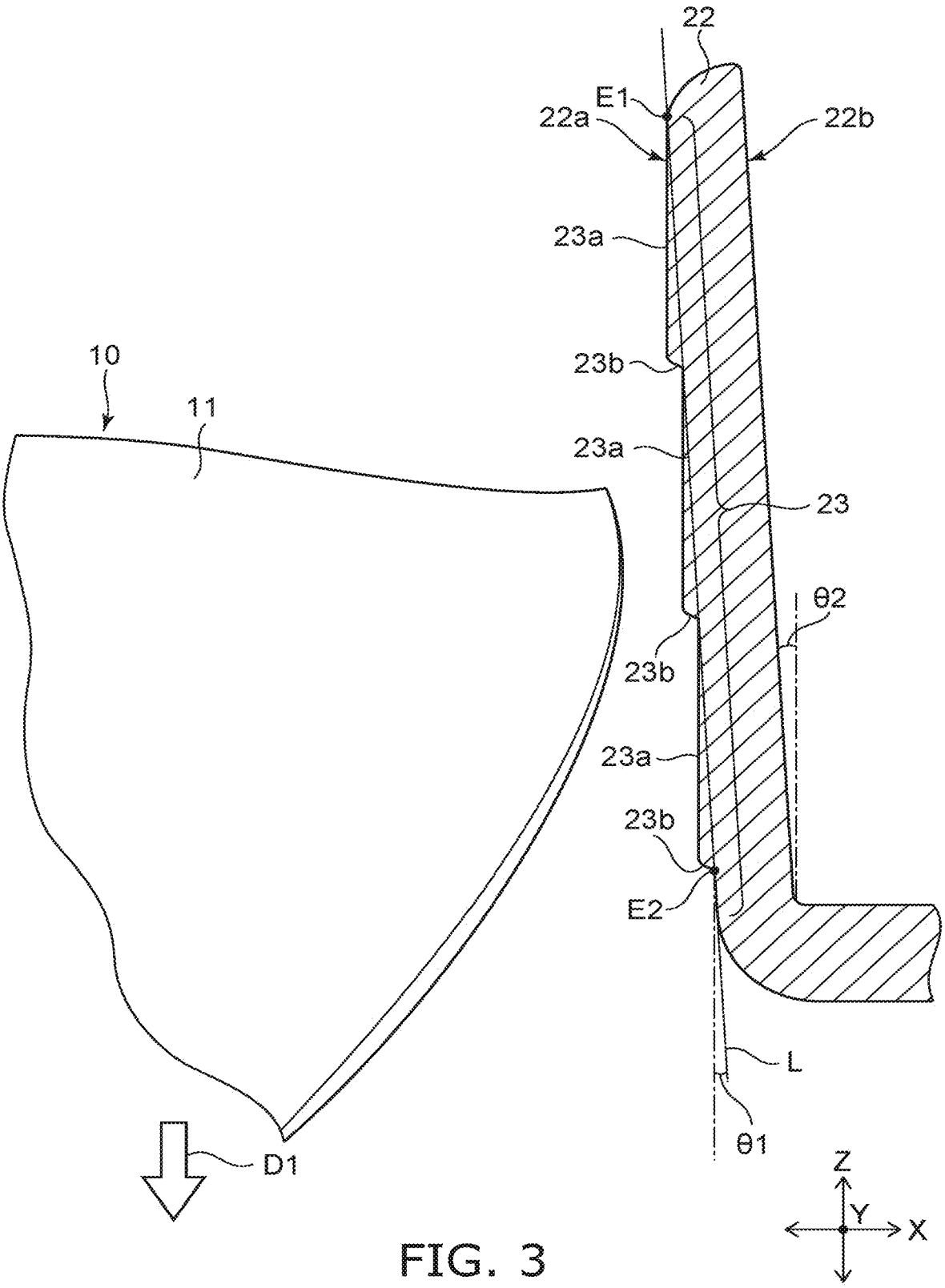
FIG. 3 is a side view showing a part of the fan according to the embodiment.

FIG. 3 is a side view showing a part of the fan according to the embodiment. FIG. 3 shows the cross-sectional structure of the bell mouth.

As shown in FIG. 3, a staircase structure 23 is provided in the inner circumferential surface 22*a* of the ring part 22. The staircase structure 23 is positioned around the blade 10 in the X-Y plane.

The staircase structure 23 includes multiple steps 23*a* arranged along the Z-direction. The steps 23*a* each are formed along the circumferential direction in the inner circumferential surface 22*a*. A riser 23*b* is formed between the steps 23*a* adjacent to each other in the Z-direction. The distance between each step 23*a* and the rotation axis R of the blade 10 increases toward the blowing direction D1. In other words, the opening that is surrounded with the staircase structure 23 spreads toward the blowing direction D1.

The outer circumferential surface 22*b* is tilted with respect to the Z-direction so that the thickness of the ring part 22 is substantially constant. A staircase structure is not provided in the outer circumferential surface 22*b*. Or, a staircase structure similar to that of the inner circumferential surface 22*a* may be provided in the outer circumferential surface 22*b*.

Advantages of the embodiment will now be described.

It is favorable for a fan to have a high blowing efficiency. The blowing efficiency can be represented using the PQ characteristic. The PQ characteristic is represented by the product of the airflow rate and the static pressure during fan operation. For example, even when the airflow rate is constant, the PQ characteristic can be improved by increasing the static pressure.

Figure 4:
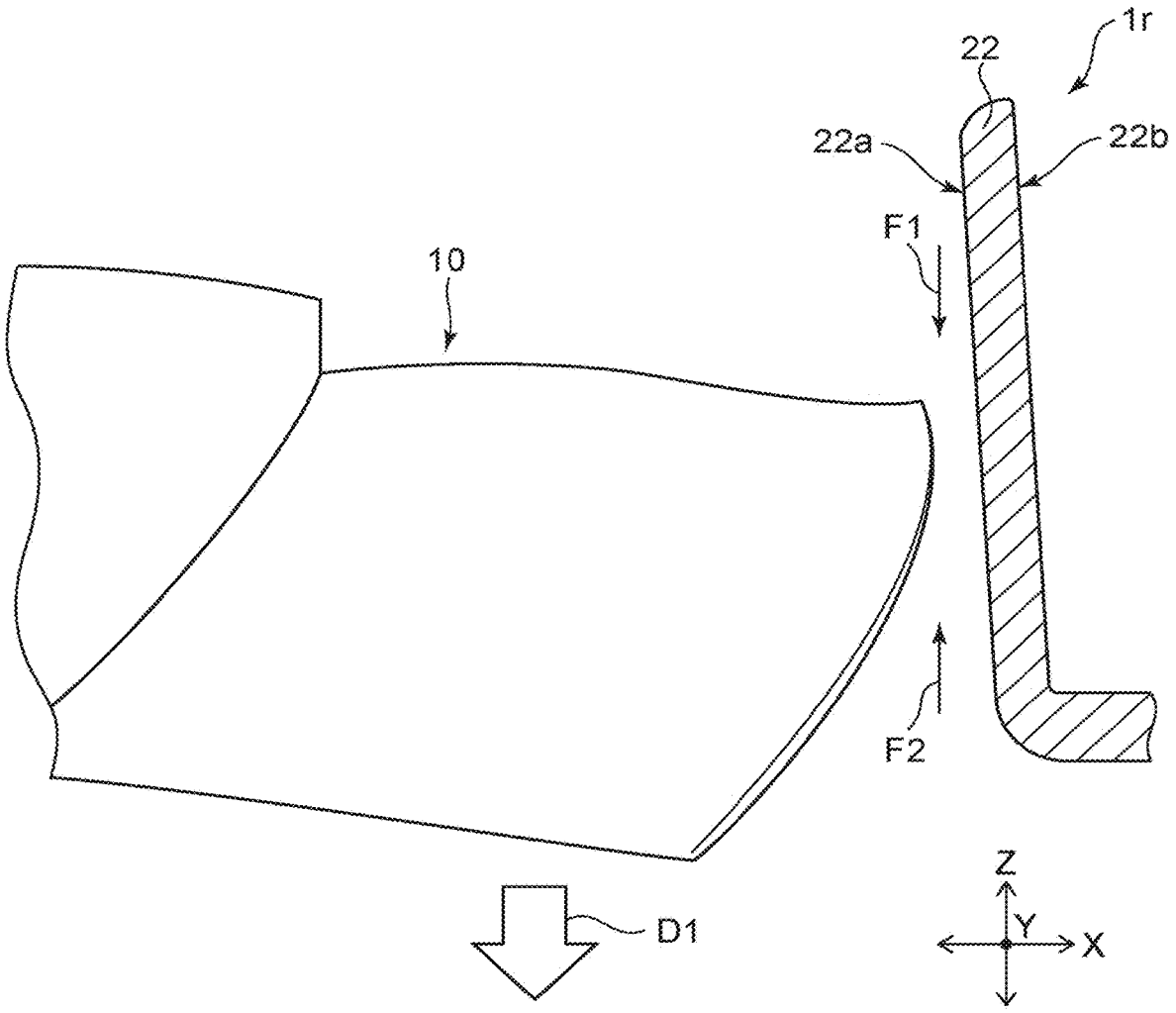
FIG. 4 is a schematic view showing a part of a fan according to a reference example.

FIG. 4 is a schematic view showing a part of a fan according to a reference example.

In the fan 1*r* according to the reference example shown in FIG. 4, a staircase structure is not provided in the inner circumferential surface 22*a* of the ring part 22. The inner circumferential surface 22*a* is flat in the blowing direction D1. When the fan 1*r* is operated, air is blown in the blowing direction D1 by the blade 10. At this time, a forward flow F1 and a backflow F2 are generated in the gap between the blade 10 and the ring part 22. The forward flow F1 is the flow of air in the blowing direction D1. The backflow F2 is the flow of air in the opposite orientation of the forward flow F1. When the flow rate of the backflow F2 is large, the static pressure decreases, and the PQ characteristic degrades. It is therefore desirable to reduce the flow rate of the backflow F2.

FIGS. 5A and 5B are schematic views showing a part of the fan according to the embodiment.

As described above, in the fan 1 according to the embodiment, the staircase structure 23 is provided in the bell mouth 20. As shown in FIG. 5A, the staircase structure 23 substantially does not act on the forward flow F1. On the other hand, as shown in FIG. 5B, the backflow F2 is obstructed by the risers 23*b* of the staircase structure 23. As a result, the flow rate of the backflow F2 can be reduced, and the static pressure can be increased. As a result, the PQ characteristic can be improved.

Figure 6:
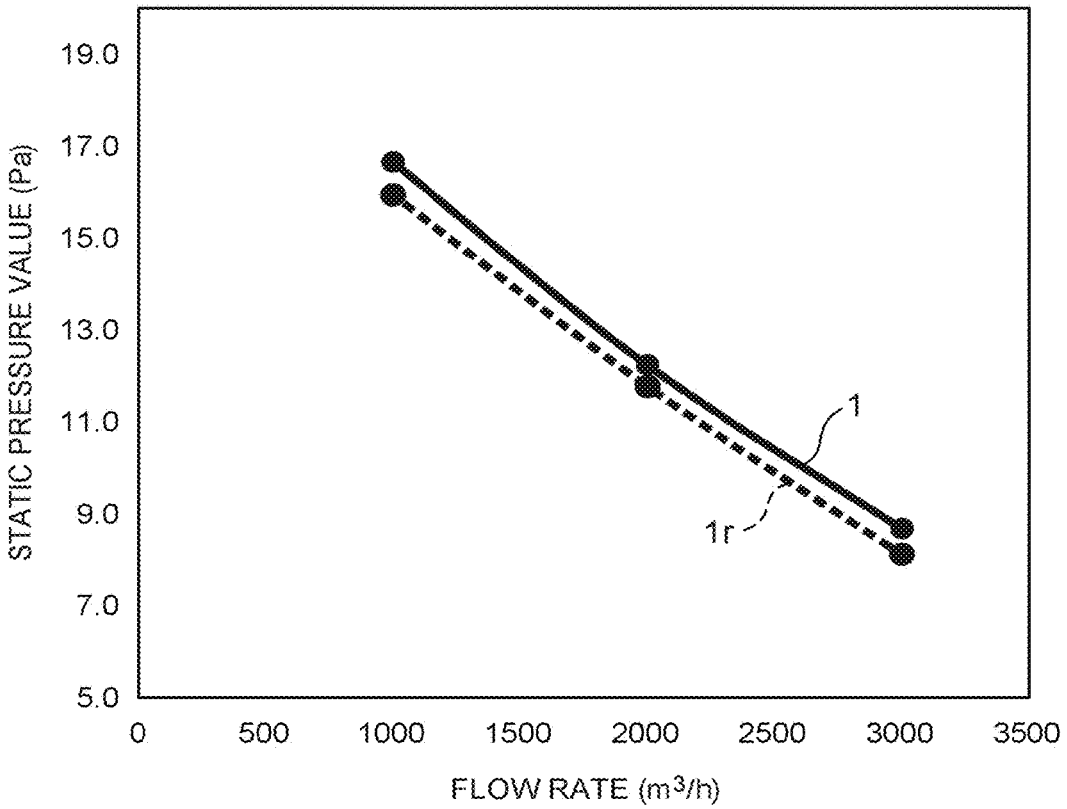
FIG. 6 is a simulation result showing characteristics of the fans according to the reference example and the embodiment.

FIG. 6 is a simulation result showing characteristics of the fans according to the reference example and the embodiment.

In FIG. 6, the horizontal axis is the flow rate ($m^3$/h). The vertical axis is the static pressure value (Pa). The solid line illustrates the characteristic of the fan 1 according to the embodiment. The broken line illustrates the characteristic of the fan 1*r* according to the reference example. The conditions related to the simulation of FIG. 6 were as follows. The diameter of the blade 10 was 58 cm. A tilt θ1 of the inner circumferential surface 22*a* with respect to the Z-direction (shown in FIG. 3) was 3 degrees. The tilt θ1 corresponds to the angle between a line segment L and the Z-direction. The line segment L was obtained by connecting one end E1 and another end E2 in the Z-direction of the staircase structure 23. A tilt θ2 of the outer circumferential surface 22*b* with respect to the Z-direction was 3 degrees.

When compared at the same flow rate, a higher static pressure has a superior PQ characteristic. It can be seen from FIG. 6 that the fan 1 according to the embodiment had a higher static pressure than the fan 1*r* according to the reference example at all flow rates. In other words, the fan 1 according to the embodiment had a better PQ characteristic than the fan 1*r* according to the reference example. According to the embodiment, the blowing efficiency of the fan can be increased.

Although a part of the blade 10 may be outside the region surrounded with the staircase structure 23, it is necessary for at least a part of the staircase structure 23 to be positioned around the blade 10 in the X-Y plane. This is because the effect of suppressing the backflow F2 is not obtained when the entire staircase structure 23 is located at a position outside the periphery of the blade 10.

Figure 7:
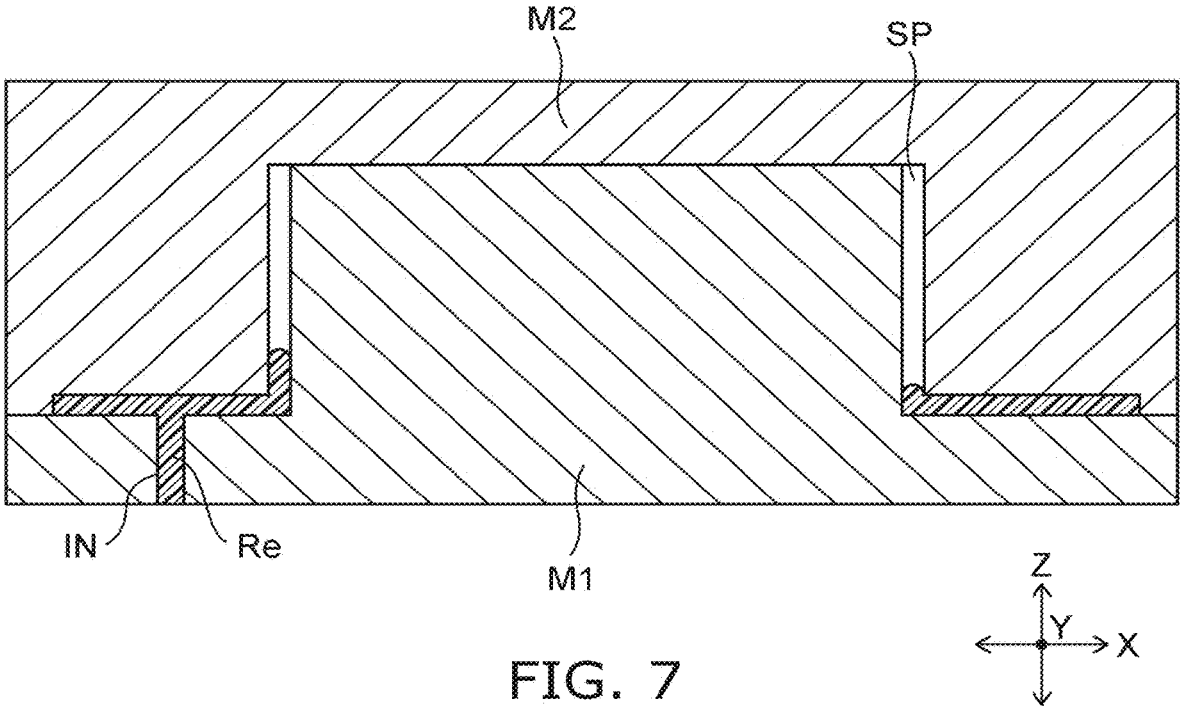
FIG. 7 is a schematic view showing a manufacturing process of the bell mouth.

FIG. 7 is a schematic view showing a manufacturing process of the bell mouth.

The bell mouth 20 can be made by injection molding. For example, as shown in FIG. 7, two molds, a mold M1 and a mold M2, are used. A space SP that corresponds to the shape of the bell mouth 20 is formed when the mold M1 and the mold M2 engage in the Z-direction. A resin Re is injected into the space SP through an injection inlet IN. The resin Re is cured after the space SP is filled with the resin Re. The bell mouth 20 is made thereby. Subsequently, the mold M1 and the mold M2 are separated from the bell mouth 20.

As shown in FIG. 3, the inner circumferential surface 22*a* (the staircase structure 23) and the outer circumferential surface 22*b* of the ring part 22 are not parallel to the Z-direction, and are tilted with respect to the Z-direction. Therefore, when separating the molds M1 and M2 from the bell mouth 20 in the Z-direction after curing the resin R, friction can be reduced, and the separation of the molds M1 and M2 is easy.

The ease of separating the mold M1 from the bell mouth 20 increases as the tilt θ1 of the inner circumferential surface 22*a* with respect to the Z-direction increases. From the perspective of the ease of separating the mold M1 and the bell mouth 20, it is favorable for the tilt θ1 to be greater than 2 degrees. On the other hand, when the tilt θ1 is too large, the gap between the blade 10 and the inner circumferential surface 22*a* at the other end E2 side may become too wide, and the PQ characteristic may excessively decrease. From the perspective of the blowing efficiency of the fan 1, it is favorable for the tilt θ1 to be less than 5 degrees.

Similarly, from the perspective of the ease of separating the mold M2 and the bell mouth 20, it is favorable for the tilt θ2 of the outer circumferential surface 22*b* with respect to the Z-direction to be greater than 2 degrees. Although the upper limit of the tilt θ2 is arbitrary, when the difference between the tilts θ1 and θ2 is excessively large, the ring part 22 becomes thicker than necessary in some locations, and an excessive amount of the resin Re is used.

Favorably, each step 23*a* of the staircase structure 23 is tilted with respect to the Z-direction. The tilts of the steps 23*a* with respect to the Z-direction are less than the tilt θ1. It is favorable for the tilts of the steps 23*a* with respect to the Z-direction to be greater than 0 degrees and less than 0.5 degrees. The tilts of the steps 23*a* make it easier to separate the mold M1 from the bell mouth 20.

(First Modification)

Figure 8:
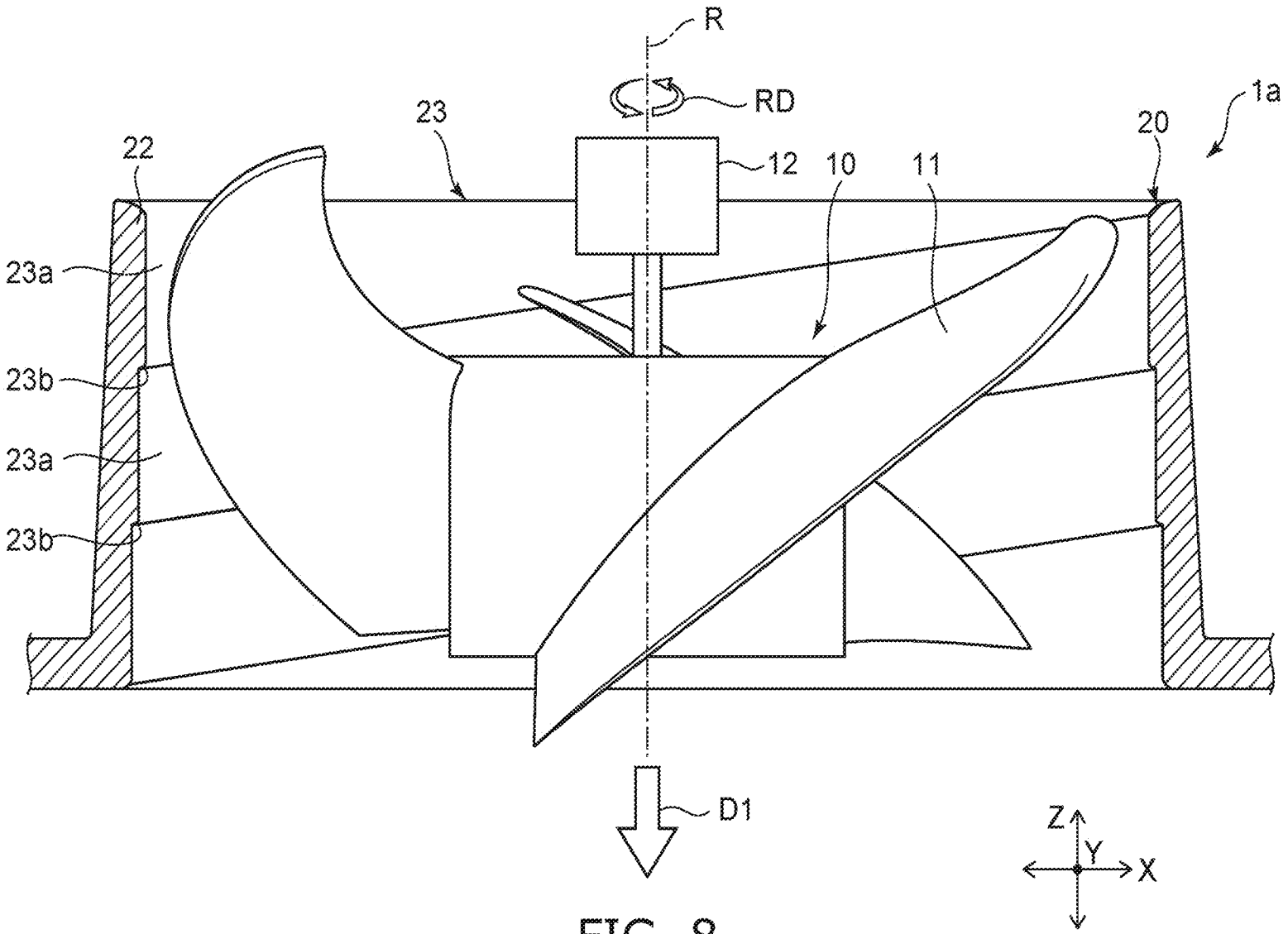
FIG. 8 is a schematic view showing a fan according to a first modification of the embodiment.

FIG. 8 is a schematic view showing a fan according to a first modification of the embodiment.

In the fan 1*a* according to the first modification, the staircase structure 23 is formed in a spiral shape centered on the rotation axis R. The spiral is formed so that the steps 23*a* rotate in the rotation direction RD of the blade 10 along the blowing direction D1.

Figure 9:
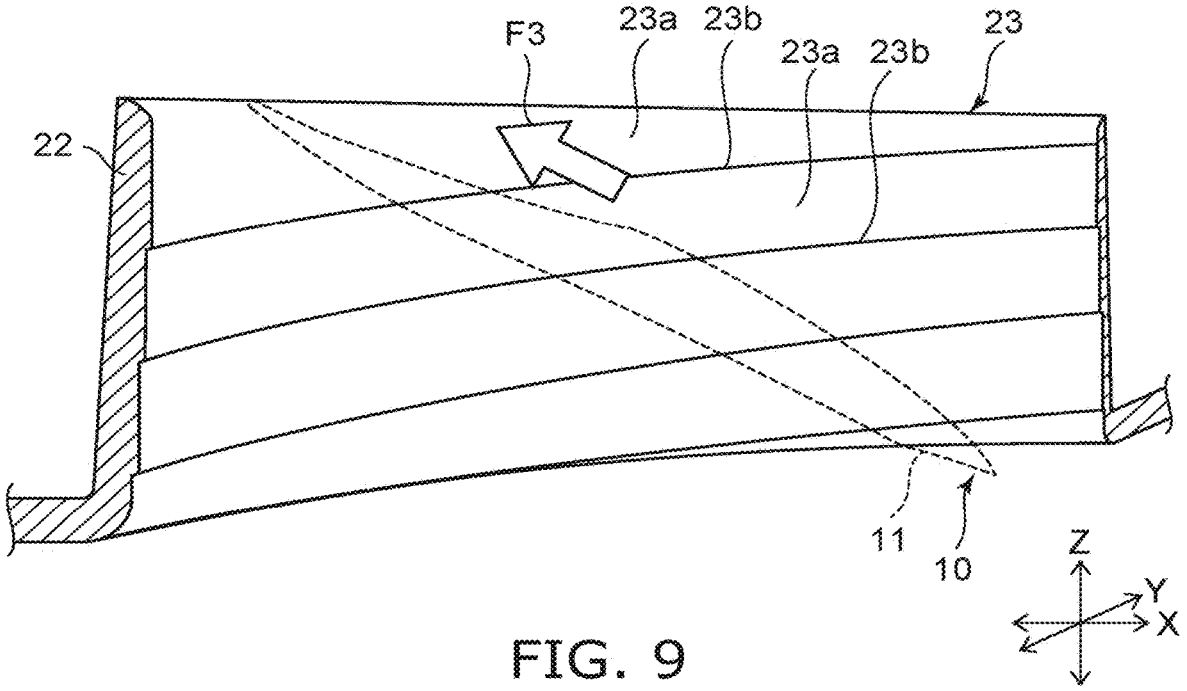
FIG. 9 is a schematic view showing a characteristic of the fan according to the first modification of the embodiment.

FIG. 9 is a schematic view showing a characteristic of the fan according to the first modification of the embodiment.

When the blade 10 is rotated, a backflow F3 along the blade 10 is generated as shown in FIG. 9. The static pressure decreases as the flow rate of the backflow F3 increases. By providing the spiral shape, the risers 23*b* of the fan 1*a* according to the first modification are formed to cross the orientation of the backflow F3. As a result, the air of the backflow F3 strikes the risers 23*b* more easily. By obstructing the backflow F3, the static pressure can be further increased. According to the first modification, the blowing efficiency can be further increased compared to the fan 1.

(Second Modification)

Figure 10:
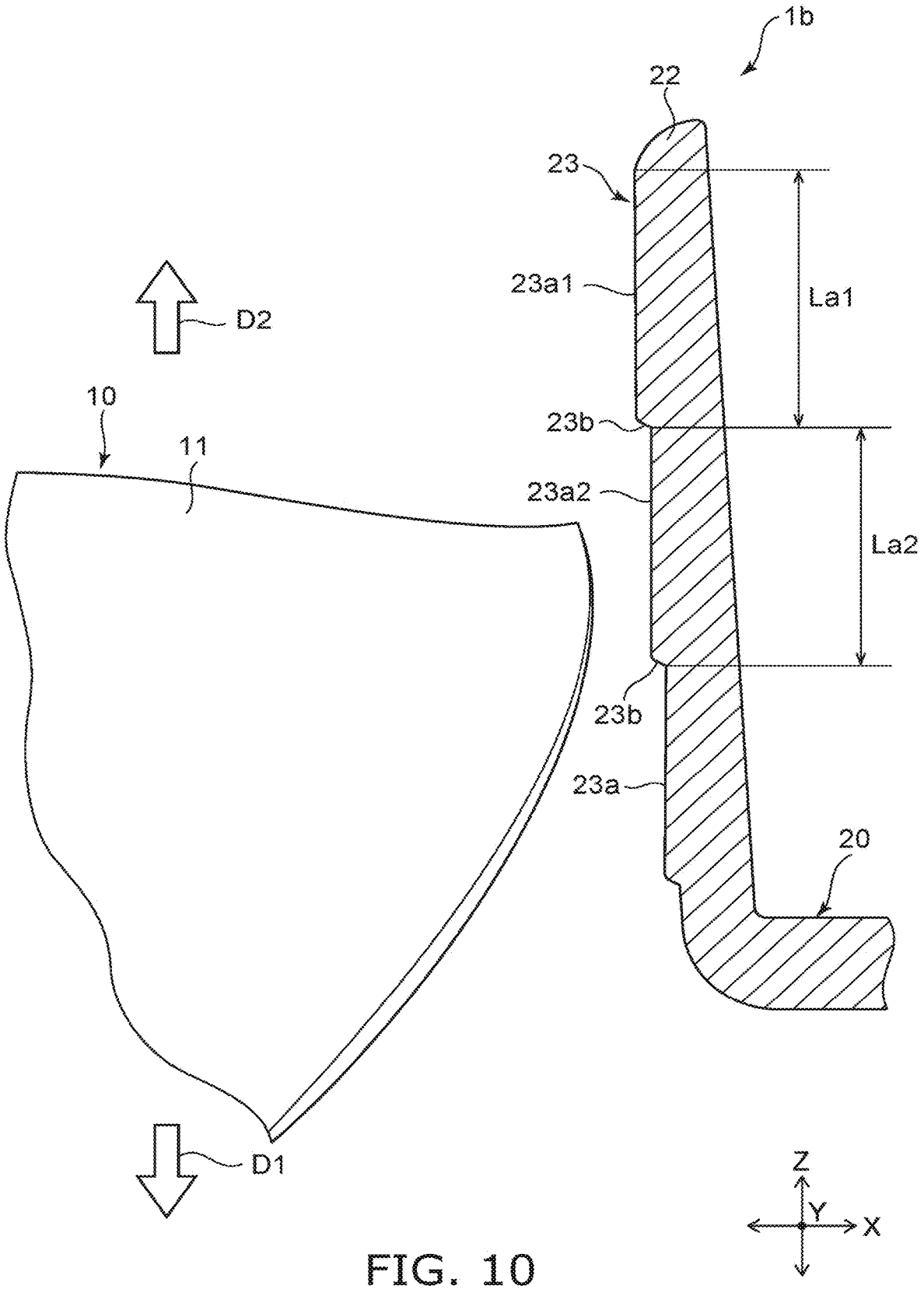
FIG. 10 is a schematic view showing a fan according to a second modification of the embodiment.

FIG. 10 is a schematic view showing a fan according to a second modification of the embodiment.

In the fan 1*b* according to the second modification, the Z-direction lengths of the steps 23*a* of the staircase structure 23 increase toward an opposite direction D2 of the blowing direction D1 as shown in FIG. 10.

For example, the multiple steps 23*a* include a step 23*a*1 and a step 23*a*2. The step 23*a*1 is positioned further toward the opposite direction D2 side than the step 23*a*2. A length La1 in the Z-direction of the step 23*a*1 is greater than a length La2 in the Z-direction of the step 23*a*2.

Compared to the downstream side of the ring part 22, the gap between the blade 10 and the staircase structure 23 is narrower at the upstream side. The static pressure is easier to increase by increasing the Z-direction length of the part at which the gap is narrow. By increasing the Z-direction length of the step 23*a* toward the opposite direction D2, the part at which the gap is narrow can be longer, and the static pressure can be increased. According to the second modification, the blowing efficiency can be further increased compared to the fan 1.

(Third Modification)

Figure 11:
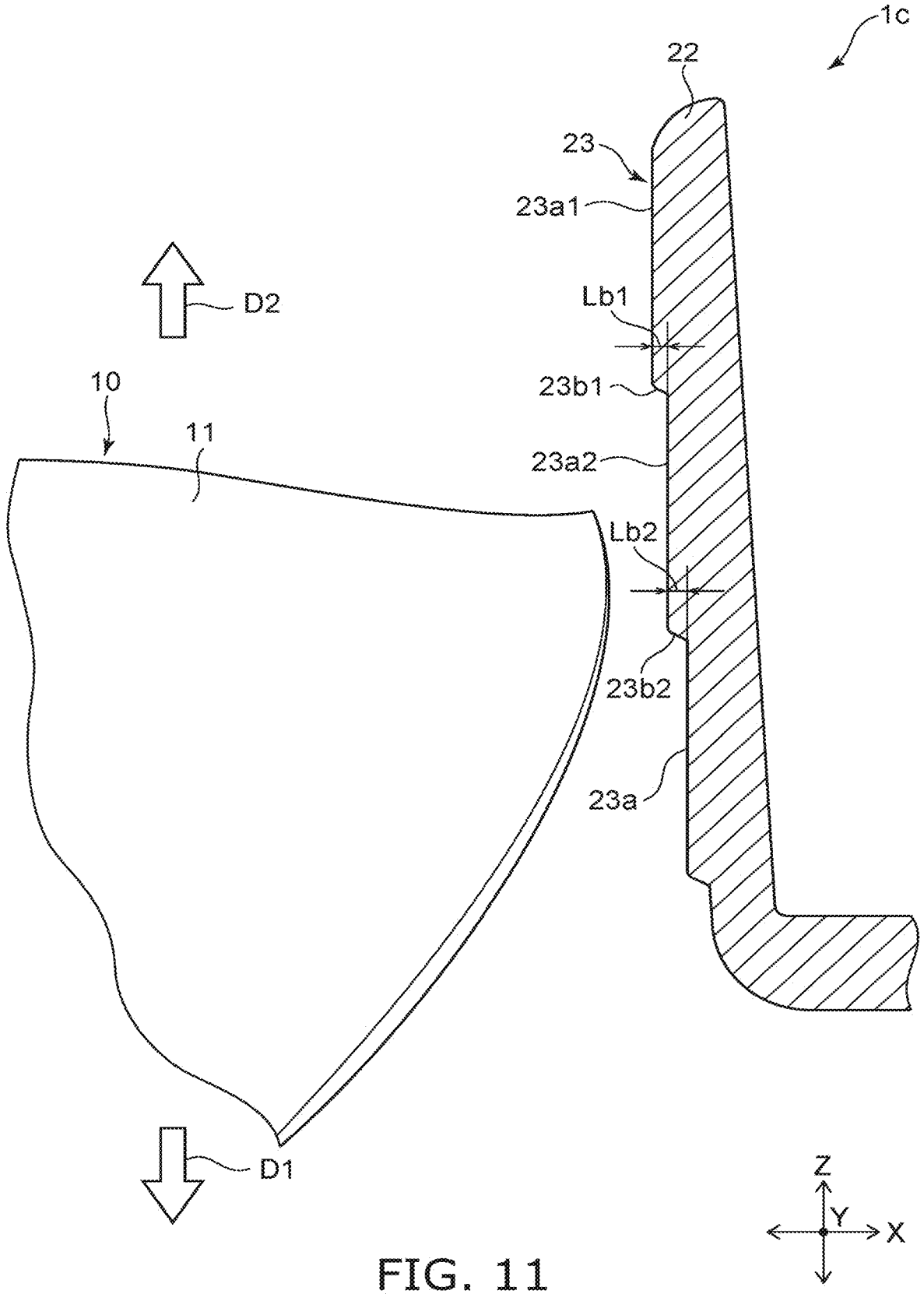
FIG. 11 is a schematic view showing a fan according to a third modification of the embodiment.

FIG. 11 is a schematic view showing a fan according to a third modification of the embodiment.

In the fan 1*c* according to the third modification, the risers 23*b* of the staircase structure 23 are smaller toward the opposite direction D2 as shown in FIG. 11.

For example, the staircase structure 23 includes risers 23*b*1 and 23*b*2. The riser 23*b*1 is positioned further toward the opposite direction D2 side than the riser 23*b*2. A size Lb1 of the riser 23*b*1 is less than a size Lb2 of the riser 23*b*2.

Compared to the downstream side of the ring part 22, the gap between the blade 10 and the staircase structure 23 is narrower at the upstream side. It is easier to increase the static pressure as the gap becomes narrower. The gap can be made narrower by reducing the size of the riser 23*b* toward the opposite direction D2. For example, compared to the fan 1, the distance between the blade 10 and the step 23*a*2 between the risers 23*b*1 and 23*b*2 can be reduced. As a result, the static pressure of the fan 1*c* can be increased. According to the third modification, the blowing efficiency can be further increased compared to the fan 1.

(Fourth Modification)

Figure 12:
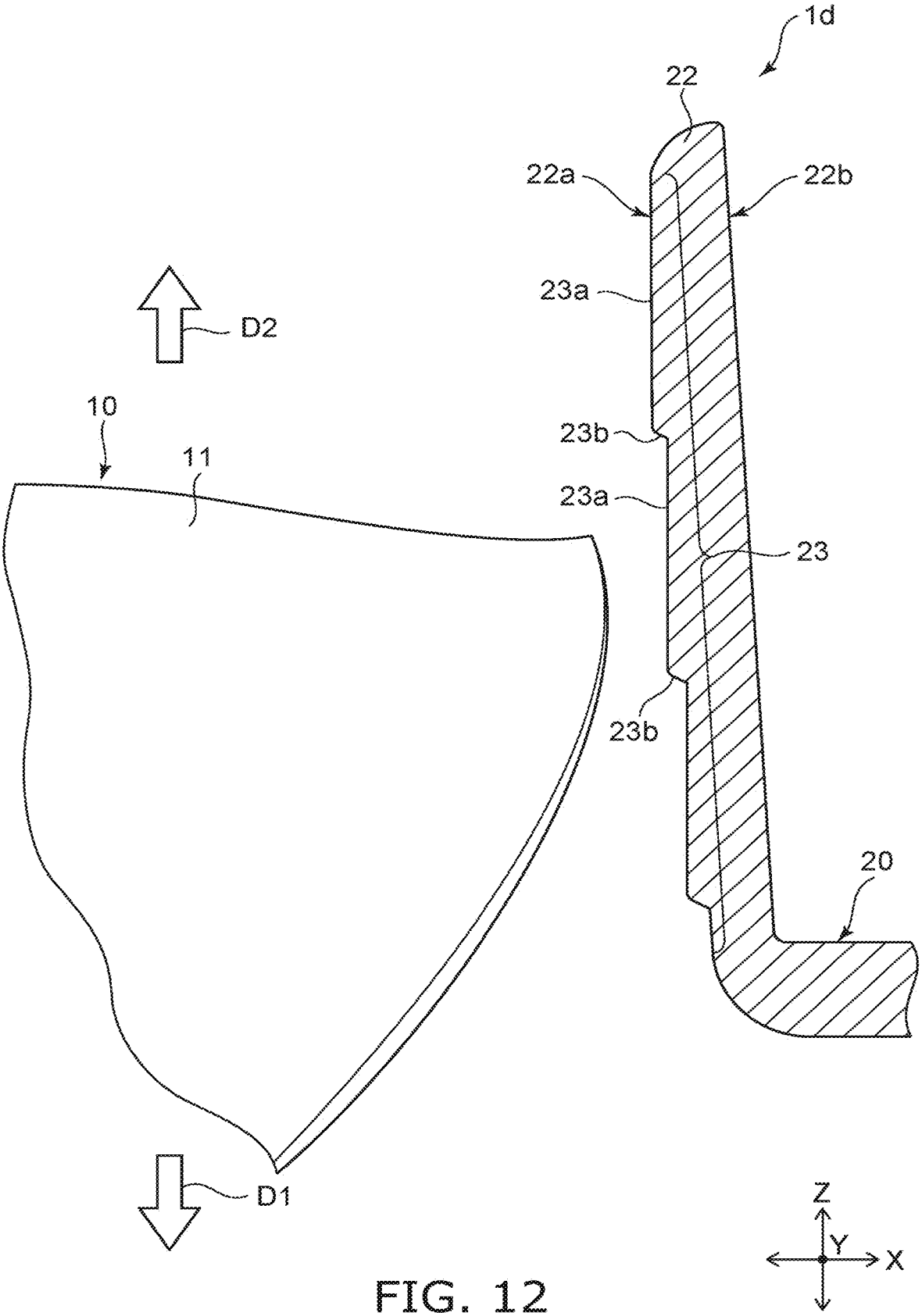
FIG. 12 is a schematic view showing a fan according to a fourth modification of the embodiment.

FIG. 12 is a schematic view showing a fan according to a fourth modification of the embodiment.

In the fan 1*d* according to the fourth modification, as shown in FIG. 12, the Z-direction length of the step 23*a* increases toward the opposite direction D2; and the riser 23*b* becomes smaller toward the opposite direction D2. The blowing efficiency can be further increased by combining the structure of the fan 1*b* according to the second modification and the structure of the fan 1*c* according to the third modification.

The embodiments of the invention may include the following Technical Proposals.

(Proposal 1)

A fan, comprising:

a blade rotating around a rotation axis, the rotation axis being along a first direction; and a bell mouth including a staircase structure, the staircase structure being positioned around the blade along a first plane, the first plane being perpendicular to the first direction, the staircase structure surrounding an opening, the opening spreading toward a blowing direction of the blade.

(Proposal 2)

The fan according to Proposal 1, wherein the bell mouth includes a ring part surrounding the blade along the first plane, the ring part includes an inner circumferential surface facing the blade, and the staircase structure is provided in the inner circumferential surface.

(Proposal 3)

The fan according to Proposal 2, wherein the ring part includes an outer circumferential surface at a side opposite to the inner circumferential surface, and the outer circumferential surface is tilted with respect to the first direction.

(Proposal 4)

The fan according to Proposal 3, wherein a tilt of the outer circumferential surface with respect to the first direction is greater than 2 degrees and less than 5 degrees.

(Proposal 5)

The fan according to any one of Proposals 1 to 4, wherein the staircase structure is formed in a spiral shape centered on the rotation axis, and a step of the staircase structure rotates, toward the blowing direction, in an opposite direction of a rotation direction of the blade.

(Proposal 6)

The fan according to any one of Proposals 1 to 5, wherein the staircase structure includes a plurality of steps, and lengths in the first direction of the plurality of steps increase toward an opposite direction of the blowing direction.

(Proposal 7)

The fan according to Proposal 6, wherein each of the plurality of steps is tilted with respect to the first direction.

(Proposal 8)

The fan according to any one of Proposals 1 to 7, wherein a plurality of risers is formed in the staircase structure, and the plurality of risers becomes smaller toward an opposite direction of the blowing direction.

While certain embodiments of the inventions have been illustrated, these embodiments have been presented by way of example only, and are not intended to limit the scope of the inventions. These novel embodiments may be embodied in a variety of other forms; and various omissions, substitutions, modifications, etc., can be made without departing from the spirit of the inventions. These embodiments and their modifications are within the scope and spirit of the inventions and are within the scope of the inventions described in the claims and their equivalents. The embodiments described above can be implemented in combination with each other.

The invention claimed is:

1. A fan, comprising:

a blade rotating around a rotation axis, the rotation axis being along a first direction; and a bell mouth including a staircase structure, the staircase structure being positioned around the blade along a first plane, the first plane being perpendicular to the first direction, and the staircase structure surrounding an opening, the opening spreading toward a blowing direction of the blade, wherein the staircase structure is formed in a spiral shape centered on the rotation axis, and a step of the staircase structure rotates, toward the blowing direction, in an opposite direction of a rotation direction of the blade.

2. The fan according to claim 1, wherein the bell mouth includes a ring part surrounding the blade along the first plane, the ring part includes an inner circumferential surface facing the blade, and the staircase structure is provided in the inner circumferential surface.

3. The fan according to claim 2, wherein the ring part includes an outer circumferential surface at a side opposite to the inner circumferential surface, and the outer circumferential surface is tilted with respect to the first direction.

4. The fan according to claim 3, wherein a tilt of the outer circumferential surface with respect to the first direction is greater than 2 degrees and less than 5 degrees.

5. The fan according to claim 2, wherein the bell mouth includes a base part having a plate shape, and the base part is provided around the ring part along the first plane and positioned on a blowing direction side of the fan.

6. The fan according to claim 1, wherein the staircase structure includes a plurality of steps, and lengths in the first direction of the plurality of steps increase toward an opposite direction of the blowing direction.

7. The fan according to claim 6, wherein each of the plurality of steps is tilted with respect to the first direction.

8. The fan according to claim 1, wherein a plurality of risers is formed in the staircase structure, and the plurality of risers becomes smaller toward an opposite direction of the blowing direction.

9. The fan according to claim 1, wherein the bell mouth has a first opening and a second opening, a direction from the first opening to the second opening is along the blowing direction, and a diameter of the second opening is greater than that of the first opening.

* * * * *